US011166601B1

(12) United States Patent
Chang et al.

(10) Patent No.: US 11,166,601 B1
(45) Date of Patent: Nov. 9, 2021

(54) CLEANING AGENT SUPPLY DEVICE

(71) Applicant: FANER AROMA PRODUCT CO., LTD., Guangzhou (CN)

(72) Inventors: Hsu-Hui Chang, New Taipei (TW); Songwen Ye, Guangzhou (CN)

(73) Assignee: FANER AROMA PRODUCT CO., LTD., Guangzhou (CN)

( * ) Notice: Subject to any disclaimer, the term of this patent is extended or adjusted under 35 U.S.C. 154(b) by 0 days.

(21) Appl. No.: 16/997,964

(22) Filed: Aug. 20, 2020

(51) Int. Cl.
*B67D 1/00* (2006.01)
*A47K 5/12* (2006.01)

(52) U.S. Cl.
CPC ..... *A47K 5/1217* (2013.01); *A47K 5/1204* (2013.01)

(58) Field of Classification Search
CPC ..... A47K 5/1217; A47K 5/1204
See application file for complete search history.

(56) References Cited

U.S. PATENT DOCUMENTS 5,105,992 A * 4/1992 Fender ..... A47K 5/1217 222/181.2
6,390,329 B1 * 5/2002 Maddox ..... A47K 5/1202 222/207
8,678,244 B2 * 3/2014 Yang ..... A47K 5/1217 222/333
2002/0063018 A1 * 5/2002 Schippers ..... F16N 29/02 184/15.1
2008/0308574 A1 * 12/2008 Ophardt ..... A47K 5/1217 222/1
2010/0051640 A1 * 3/2010 Chen ..... A47K 5/1209 222/52
2010/0137802 A1 * 6/2010 Yodfat ..... A61M 5/1452 604/152
2014/0217123 A1 * 8/2014 Ophardt ..... A47K 5/1217 222/190
2016/0309967 A1 * 10/2016 Pelfrey ..... G05D 7/0676
2017/0156549 A1 * 6/2017 Xie ..... F04B 49/065

* cited by examiner

*Primary Examiner* — Vishal Pancholi
*Assistant Examiner* — Bob Zadeh

(57) ABSTRACT

A cleaning agent supply device includes a holder; a power unit disposed at the holder; a rotary driving unit disposed at the holder, connected to the power unit, and having a radian-adjustable fan-shaped light-blocking unit; a photosensitive counting unit disposed at the holder and adapted to sense the radian-adjustable fan-shaped light-blocking unit; a reciprocating squeezing unit disposed at the holder, connected to the rotary driving unit, and adapted to squeeze a cleaning agent pump reciprocatingly; and a count control unit disposed at the holder, electrically connected to the power unit and the photosensitive counting unit, and adapted to control the number of times the radian-adjustable fan-shaped light-blocking unit passes the photosensitive counting unit, thereby controlling the number of times of squeezing out a cleaning agent.

10 Claims, 8 Drawing Sheets

CLEANING AGENT SUPPLY DEVICE

BACKGROUND OF THE INVENTION

1. Field of the Invention

The present disclosure relates to cleaning agent supply devices, and in particular to a cleaning agent supply device advantageous in that the number of times of squeezing out its cleaning agent is controllable.

2. Description of the Related Art

To prevent the spread of contagious viral diseases, public spaces, private spaces, and residences are armed with electrically-driven sanitizer or disinfectant supply apparatuses. Conventional electrically-driven sanitizer or disinfectant supply apparatuses are driven with motors to supply sanitizers or disinfectants. Conventional electrically-driven sanitizer or disinfectant supply apparatuses supply sanitizers or disinfectants in a fixed amount regardless of variable user needs. As a result, conventional electrically-driven sanitizer or disinfectant supply apparatuses often fail to meet user needs.

BRIEF SUMMARY OF THE INVENTION

An objective of the present disclosure is to provide a cleaning agent supply device advantageous in that the number of times of squeezing out its cleaning agent is controlled by a radian.

To achieve at least the above objective, the present disclosure provides a cleaning agent supply device, comprising: a holder; a power unit disposed at the holder; a rotary driving unit disposed at the holder, connected to the power unit, and having a radian-adjustable fan-shaped light-blocking unit; a photosensitive counting unit disposed at the holder and adapted to sense the radian-adjustable fan-shaped light-blocking unit; a reciprocating squeezing unit disposed at the holder, connected to the rotary driving unit, and adapted to squeeze a cleaning agent pump reciprocatingly; and a count control unit disposed at the holder, electrically connected to the power unit and the photosensitive counting unit, and adapted to control the number of times the radian-adjustable fan-shaped light-blocking unit passes the photosensitive counting unit.

In the embodiment, the holder has a vertical receiving room flanked with two first vertical guiding units each, and the reciprocating squeezing unit is flanked with two second vertical guiding units connected to the first vertical guiding units, respectively.

In the embodiment, the cleaning agent supply device further comprises a speed-changing gear train connected between the power unit and the rotary driving unit.

In the embodiment, the rotary driving unit has an eccentric guiding post, and the reciprocating squeezing unit has a horizontal guiding groove which the eccentric guiding post is disposed in.

In the embodiment, the radian-adjustable fan-shaped light-blocking unit has a plurality of ridge-and-furrow reflecting units.

In the embodiment, the photosensitive counting unit is U-shaped to sense the radian-adjustable fan-shaped light-blocking unit, and the reciprocating squeezing unit is U-shaped.

In the embodiment, the count control unit has a power switch, a power indicating unit, a time number setting unit, a squeezing count indicating unit, a hand sensing unit and a power supply unit.

In the embodiment, a first blocking frame is disposed between the rotary driving unit and the holder.

In the embodiment, the holder has a battery receiving chamber, a battery lid, and a second blocking frame disposed between the battery lid and the battery receiving chamber.

In the embodiment, the cleaning agent supply device further comprises a rear plate and a third blocking frame disposed between the rear plate and the holder.

Therefore, the cleaning agent supply device of the present disclosure controls the number of times of squeezing out a cleaning agent.

DETAILED DESCRIPTION OF THE INVENTION

To facilitate understanding of the object, characteristics and effects of this present disclosure, embodiments together with the attached drawings for the detailed description of the present disclosure are provided.

Figure 1:
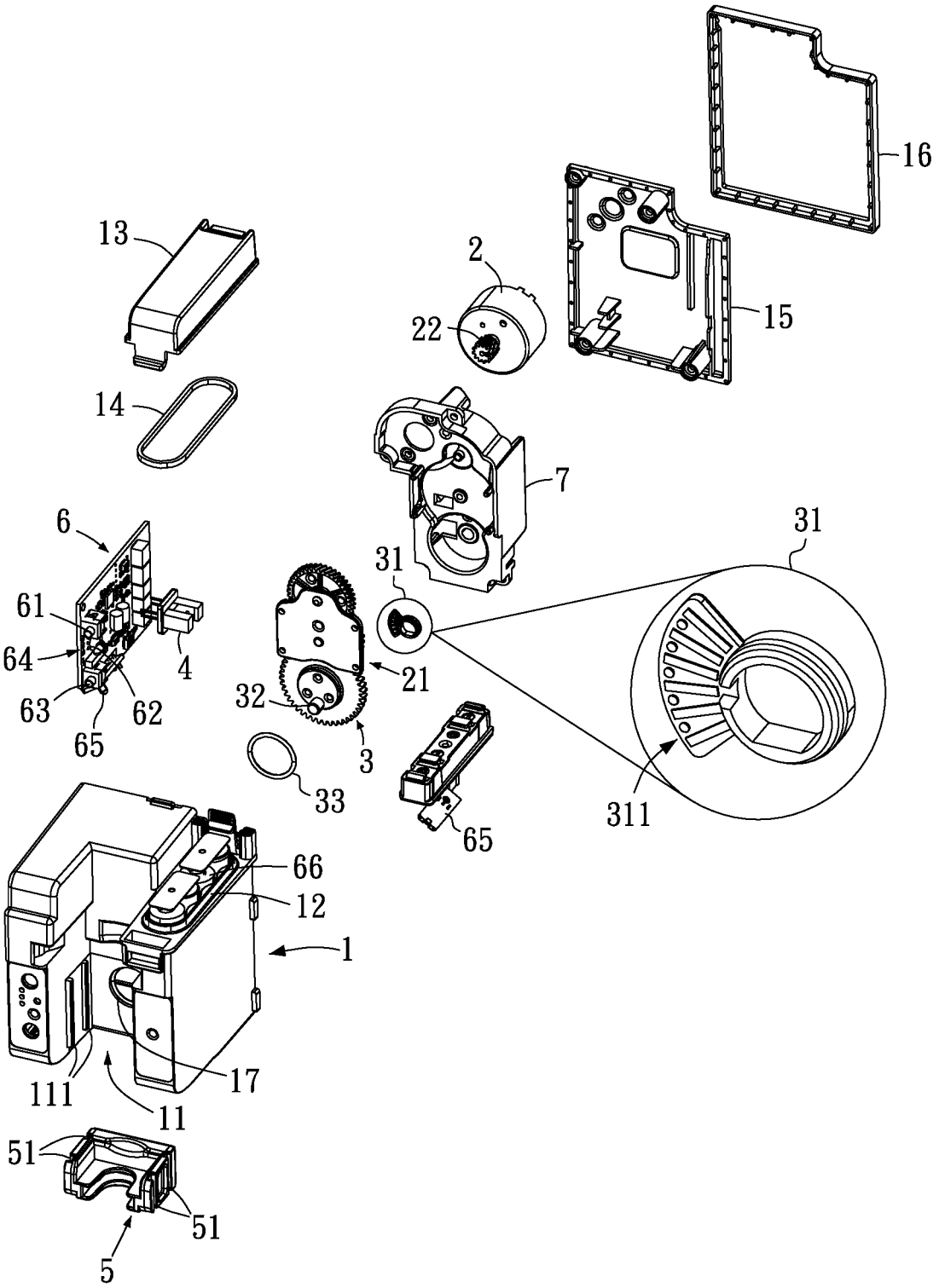
FIG. 1 is the first exploded view of a cleaning agent supply device according to an embodiment of the present disclosure.
Figure 2:
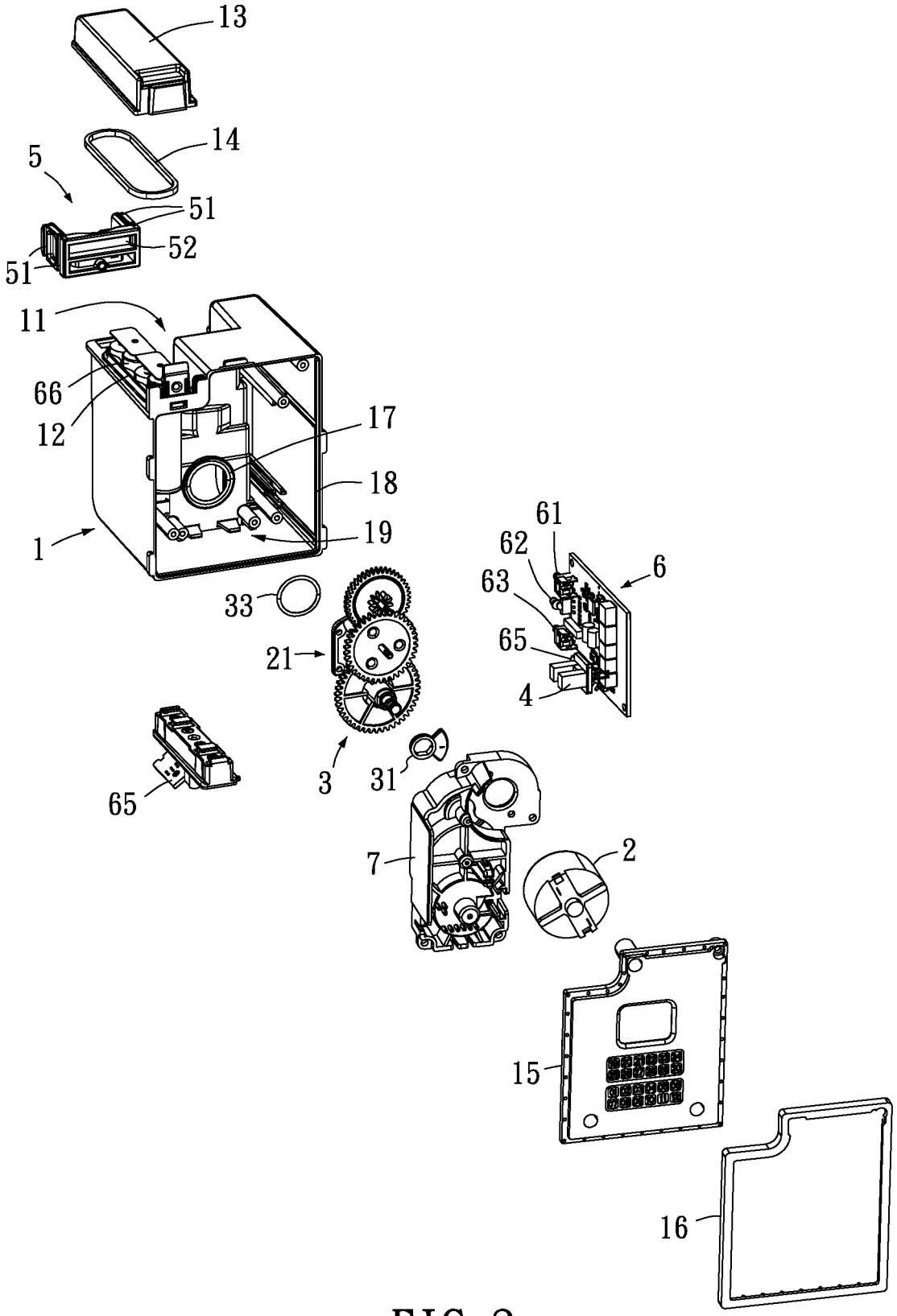
FIG. 2 is the second exploded view of the cleaning agent supply device according to an embodiment of the present disclosure.
Figure 3:
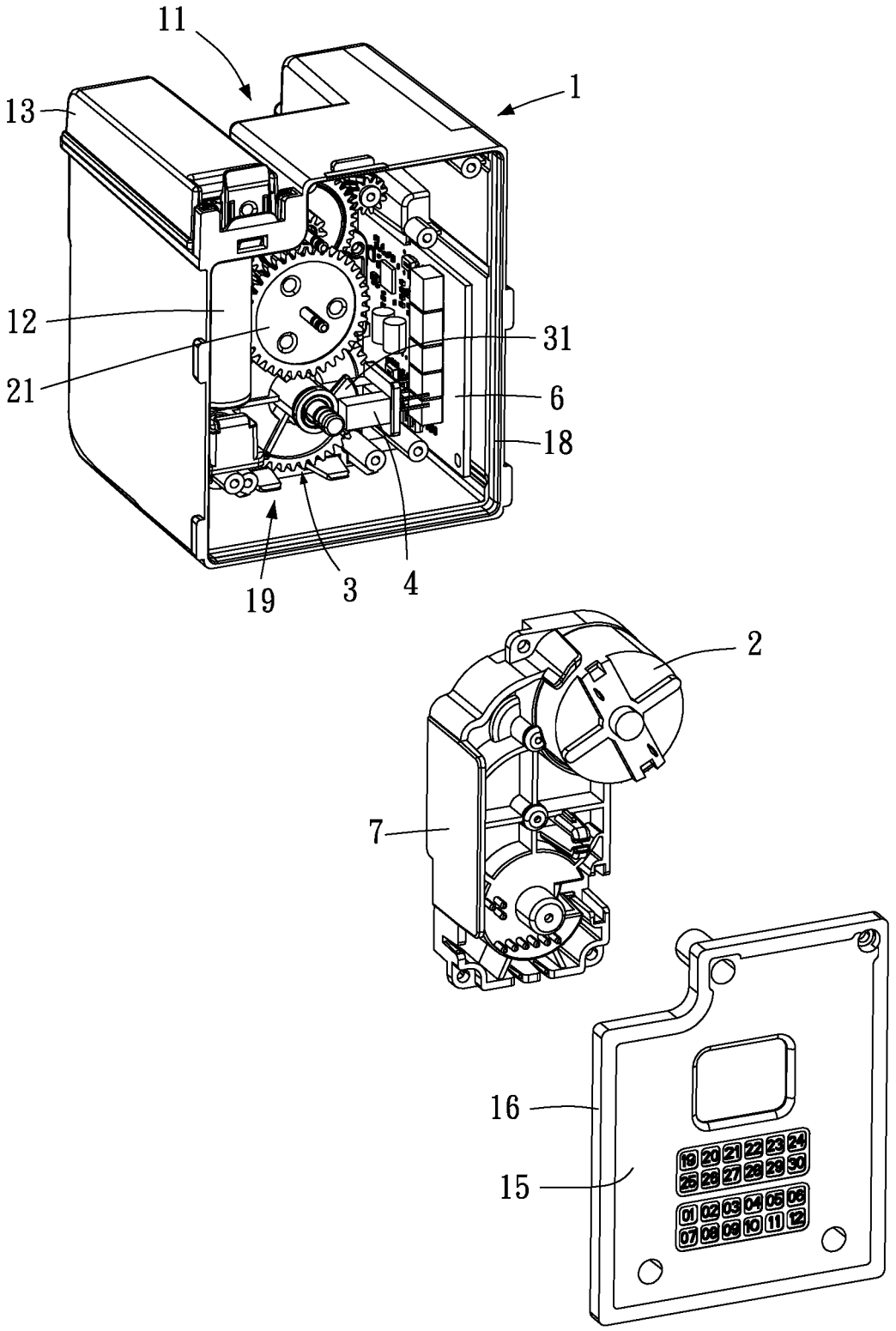
FIG. 3 is a first partial assembled schematic view of the cleaning agent supply device according to an embodiment of the present disclosure.
Figure 4:
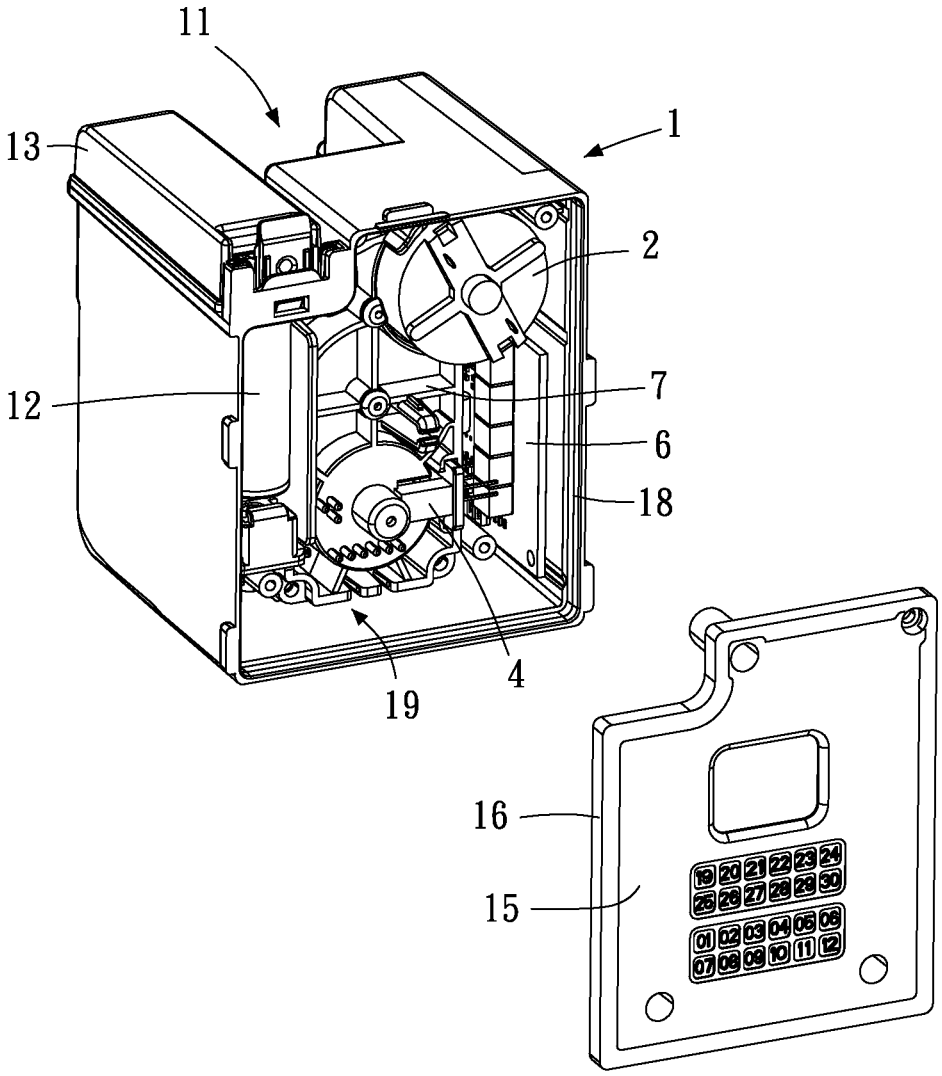
FIG. 4 is a second partial assembled schematic view of the cleaning agent supply device according to an embodiment of the present disclosure.
Figure 5:
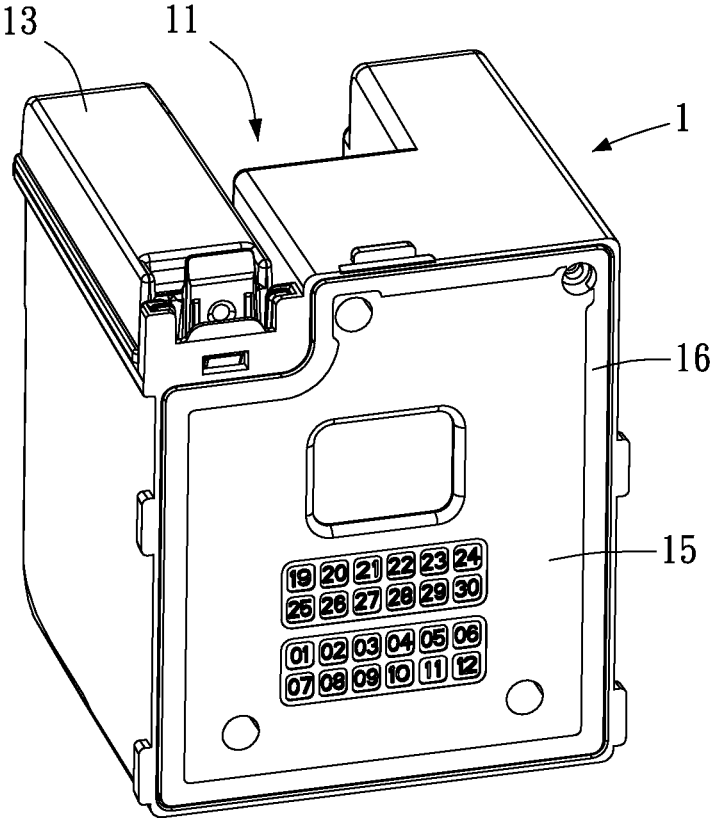
FIG. 5 is a first assembled schematic view of the cleaning agent supply device according to an embodiment of the present disclosure.

Referring to FIG. 1 and FIG. 2, the present disclosure provides a cleaning agent supply device, comprising a holder 1, a power unit 2, a rotary driving unit 3, a photosensitive counting unit 4, a reciprocating squeezing unit 5 and a count control unit 6. The holder 1 has a front opening 17, a rear opening 18 and a receiving space 19. Referring to FIG. 3 and FIG. 4, the power unit 2 is a motor and is disposed in the receiving space 19 of the holder 1 through a cover 7. The rotary driving unit 3 is a gear (or a pulley connected to a belt or any other rotatable element) and is disposed in the receiving space 19 of the holder 1 through the cover 7. The front of the rotary driving unit 3 is exposed from the front opening 17 of the holder 1 to drive the reciprocating squeezing unit 5 to undergo reciprocating motion. The rotary driving unit 3 is connected to the gear (or a pulley connected to a belt or any other rotatable element) of the power unit 2. The rotary driving unit 3 has a radian-adjustable fan-shaped light-blocking unit 31. The radian-adjustable fan-shaped light-blocking unit 31 is a fan-shaped board which fits to the rear side of the rotary driving unit 3. The radian-adjustable fan-shaped light-blocking unit 31 can be cut to adjust its radian, so as to adjust the squeezing position (or rotation angle of the rotary driving unit 3) of the reciprocating squeezing unit 5. The photosensitive counting unit 4 is an infrared sensor and is disposed in the receiving space 19 of the holder 1. The photosensitive counting unit 4 senses the passage count of the radian-adjustable fan-shaped light-blocking unit 31. The reciprocating squeezing unit 5 is disposed at the front of the holder 1 and connected to the rotary driving unit 3. The reciprocating squeezing unit 5 squeezes a cleaning agent pump (not shown) reciprocatingly, such that the cleaning agent pump squeezes a cleaning agent (not shown) out of a cleaning agent container (not shown). The count control unit 6 is a control circuit board (or a control chip) and has a CPU, a memory, a processing circuit (or a processing chip), a counter and a count controller. The count control unit 6 is disposed in the receiving space 19 of the holder 1 and electrically connected to the power unit 2 and the photosensitive counting unit 4. The count control unit 6 controls the number of times the radian-adjustable fan-shaped light-blocking unit 31 passes through the photosensitive counting unit 4.

As mentioned before, the count control unit 6 controls the power unit 2 to drive the rotation of the rotary driving unit 3. The rotary driving unit 3 drives the reciprocating squeezing unit 5 to undergo reciprocating motion. The photosensitive counting unit 4 senses the passage count of the radian-adjustable fan-shaped light-blocking unit 31. The count control unit 6 controls the number of times the radian-adjustable fan-shaped light-blocking unit 31 passes the photosensitive counting unit 4. The number of times the radian-adjustable fan-shaped light-blocking unit 31 passes the photosensitive counting unit 4 equals the number of revolutions of the rotary driving unit 3, the number of round trips made by the reciprocating squeezing unit 5, and the number of times the reciprocating squeezing unit 5 squeezes the cleaning agent pump (and the cleaning agent container). Therefore, a user uses the count control unit 6 to control the number of times the cleaning agent is squeezed out and thereby controls the amount of the cleaning agent thus squeezed out. The number of times the cleaning agent is squeezed out is proportional to the amount of the cleaning agent thus squeezed out.

Figure 6:
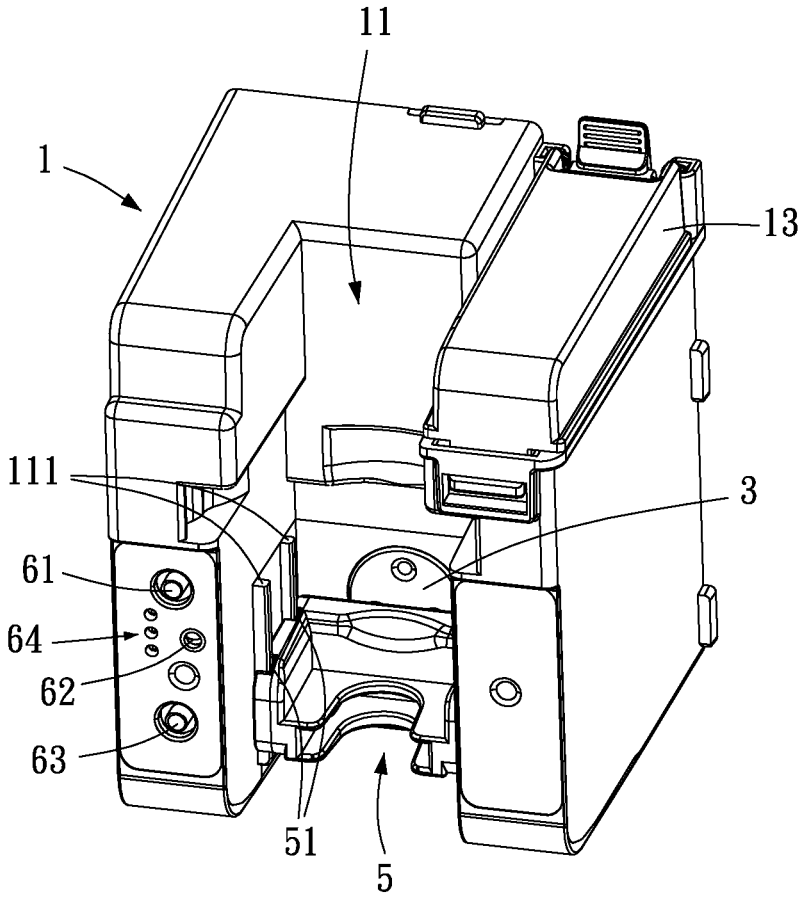
FIG. 6 is a second assembled schematic view of the cleaning agent supply device according to an embodiment of the present disclosure.
Figure 7:
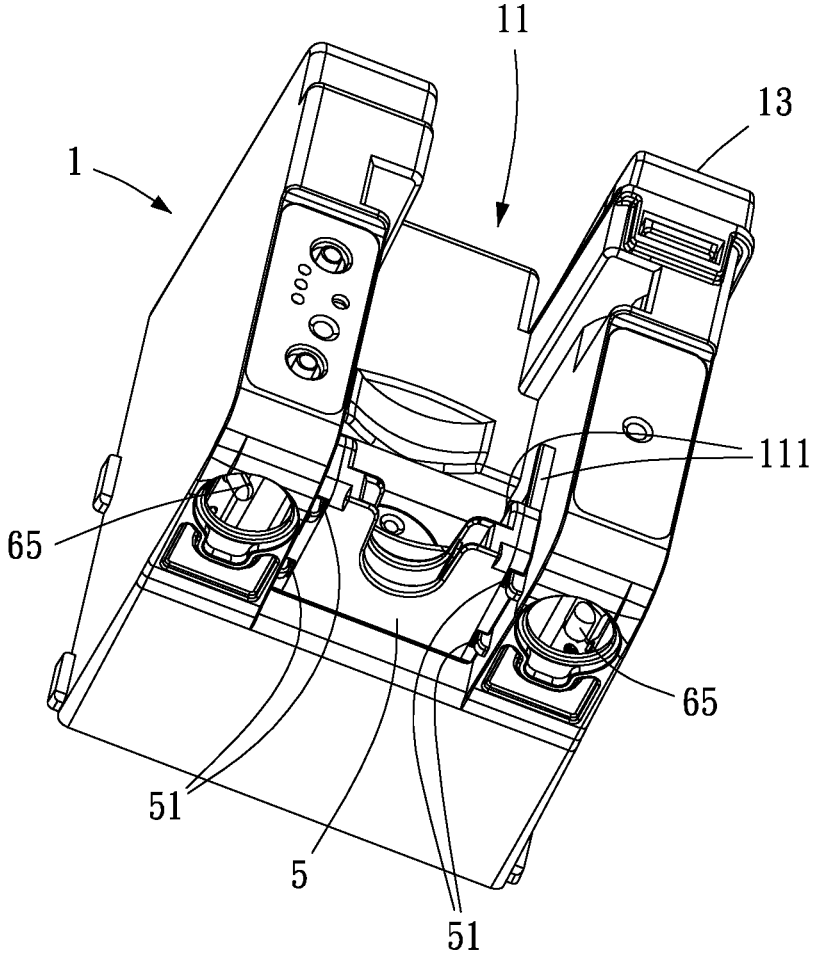
FIG. 7 is a third assembled schematic view of the cleaning agent supply device according to an embodiment of the present disclosure.
Figure 8:
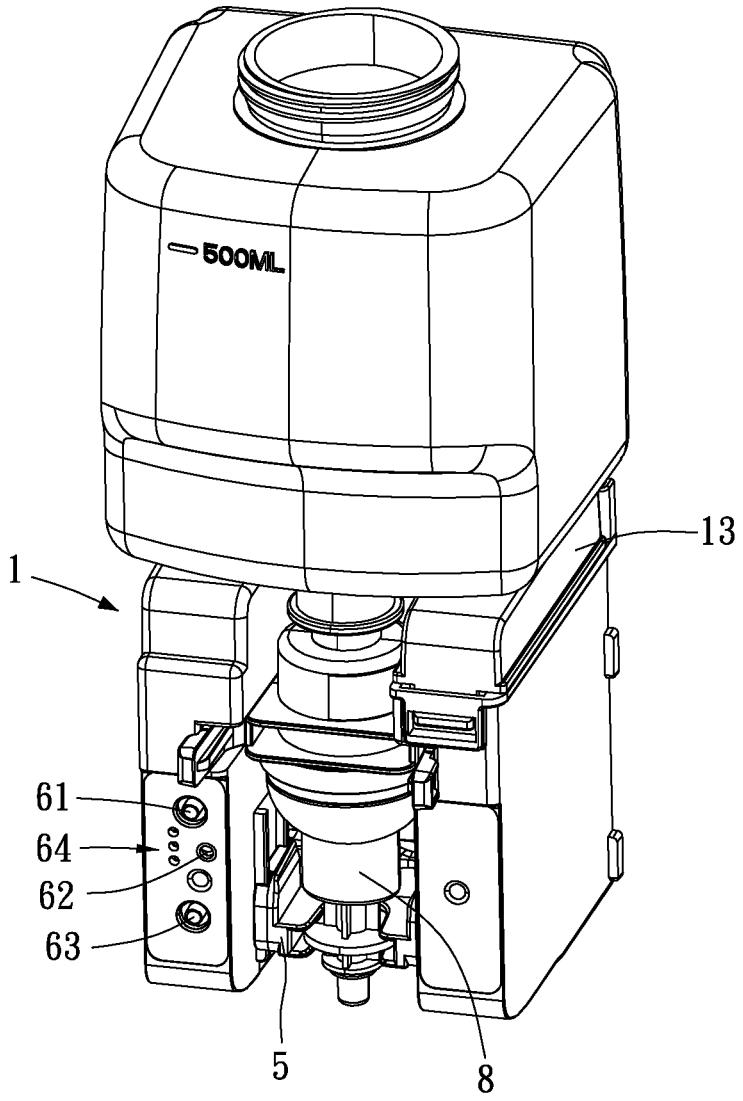
FIG. 8 is a schematic view showing the reciprocating squeezing unit squeezing a cleaning agent pump according to an embodiment of the present disclosure.

Referring to FIG. 1, FIG. 6 and FIG. 7, in the embodiment, the holder 1 has a vertical receiving room 11 which is open. The vertical receiving room 11 is flanked with two first vertical guiding units 111 each (for example, guiding rails). The reciprocating squeezing unit 5 is flanked with two second vertical guiding units 51 each (for example, guiding grooves). The first vertical guiding units 111 are connected to the second vertical guiding units 51, respectively. Therefore, the reciprocating squeezing unit 5 undergoes reciprocating motion vertically to reciprocatingly squeeze the cleaning agent pump (and the cleaning agent container) and thus squeeze out the cleaning agent.

Referring to FIG. 1 through FIG. 3, in the embodiment, the cleaning agent supply device of the present disclosure further comprises a speed-changing gear train 21 connected between a gear of the power unit 2 and the rotary driving unit 3. The speed-changing gear train 21 is disposed in the receiving space 19 of the holder 1 through the cover 7. Therefore, the speed-changing gear train 21 of the power unit 2 adjusts the rotation speed of the rotary driving unit 3 and the squeezing speed of the reciprocating squeezing unit 5.

Referring to FIG. 1 and FIG. 2, in the embodiment, the rotary driving unit 3 has an eccentric guiding post 32, and the reciprocating squeezing unit 5 has a horizontal guiding groove 52. The eccentric guiding post 32 penetrates the front opening 17 of the holder 1 so as to be disposed in the horizontal guiding groove 52. Therefore, the rotary driving unit 3 drives the reciprocating squeezing unit 5 to undergo reciprocating motion vertically to reciprocatingly squeeze the cleaning agent pump (and the cleaning agent container) and thus squeeze out the cleaning agent.

Referring to FIG. 1 through FIG. 3, in the embodiment, the radian-adjustable fan-shaped light-blocking unit 31 has a plurality of ridge-and-furrow reflecting units 311. The ridge-and-furrow reflecting units 311 radiate from the center of the radian-adjustable fan-shaped light-blocking unit 31. Therefore, the count control unit 6 fine-tunes the squeezing position (or rotation angle of the rotary driving unit) of the reciprocating squeezing unit 5 through the photosensitive counting unit 4 and the ridge-and-furrow reflecting units 311 of the radian-adjustable fan-shaped light-blocking unit 31.

Referring to FIG. 1 and FIG. 2, in the embodiment, the photosensitive counting unit 4 is U-shaped so as to sense the radian-adjustable fan-shaped light-blocking unit 31. Furthermore, the reciprocating squeezing unit 5 is U-shaped so as to connect to the cleaning agent pump.

Referring to FIG. 1, FIG. 2, FIG. 6 and FIG. 7, in the embodiment, the count control unit 6 has a power switch 61, a power indicating unit 62 (for example, a lamp), a time number setting unit 63 (for example, a key), a squeezing count indicating unit 64 (for example, a plurality of lamps), a hand sensing unit 65 (for example, an infrared sensor) and a power supply unit 66 (for example, at least one battery or utility power). The power switch 61 is disposed at the front of the holder 1 to render it convenient to start and shut down the cleaning agent supply device of the present disclosure, for example, start by pressing once, shut down by pressing twice, and restart by pressing thrice. The power indicating unit 62 is disposed at the front of the holder 1 to indicate whether the cleaning agent supply device is powered or not. The time number setting unit 63 is disposed at the front of the holder 1 to set the number of times the cleaning agent supply device squeezes the cleaning agent pump, for example, press once to squeeze once, press twice to squeeze twice, press thrice to squeeze thrice, and press four times to squeeze once again. The squeezing count indicating unit 64 is disposed at the front of the holder 1 to indicate the squeezing count which the cleaning agent pump is set to, for example, squeeze once when one lamp is on, squeeze twice when two lamps are on, and squeeze thrice when three lamps are on. The hand sensing unit 65 is disposed at the bottom of the holder 1 to sense whether the user's hands are ready. The power supply unit 66 is disposed inside or outside the holder 1 to supply power to all the electronic components of the cleaning agent supply device.

Referring to FIG. 1 and FIG. 2, in the embodiment, a first blocking frame 33 is disposed between the rotary driving unit 3 and the front opening 17 of the holder 1. The first blocking frame 33 is a durable rubber frame which prevents water or any foreign body from intruding into the holder 1 via the front opening 17.

Referring to FIG. 1 and FIG. 6, in the embodiment, the holder 1 has a battery receiving chamber 12, a battery lid 13 and a second blocking frame 14. The second blocking frame 14 is disposed between the battery lid 13 and the battery receiving chamber 12. The second blocking frame 14 is a rubber frame which prevents water or any foreign body from intruding into the battery receiving chamber 12.

Referring to FIG. 2 through FIG. 5, in the embodiment, the cleaning agent supply device of the present disclosure further comprises a rear plate 15 and a third blocking frame 16. The third blocking frame 16 is disposed between the rear plate 15 and the rear opening 18 of the holder 1. The third blocking frame 16 is a rubber frame which prevents water or any foreign body from intruding into the holder 1 via the rear opening 18. The rear plate 15 is made of hard plastic, and the third blocking frame 16 is made of soft plastic. The third blocking frame 16 is coupled to the rear plate 15 by co-molding.

While the present disclosure has been described by means of specific embodiments, numerous modifications and variations could be made thereto by those skilled in the art without departing from the scope and spirit of the present disclosure set forth in the claims.

What is claimed is:

1. A cleaning agent supply device, comprising:

a holder;

a power unit disposed at the holder;

a rotary driving unit disposed at the holder, connected to the power unit, and having a radian-adjustable fan-shaped light-blocking unit;

a photosensitive counting unit disposed at the holder and adapted to sense the radian-adjustable fan-shaped light-blocking unit;

a reciprocating squeezing unit disposed at the holder, connected to the rotary driving unit, and adapted to squeeze a cleaning agent pump reciprocatingly, and adapted to squeeze a cleaning agent pump reciprocatingly; and a count control unit disposed at the holder, electrically connected to the power unit and the photosensitive counting unit, and adapted to control the number of times the radian-adjustable fan-shaped light-blocking unit passes the photosensitive counting unit.

2. The cleaning agent supply device of claim 1, wherein the holder has a vertical receiving room flanked with two first vertical guiding units each, and the reciprocating squeezing unit is flanked with two second vertical guiding units connected to the first vertical guiding units, respectively.

3. The cleaning agent supply device of claim 1, further comprising a speed-changing gear train connected between the power unit and the rotary driving unit.

4. The cleaning agent supply device of claim 1, wherein the rotary driving unit has an eccentric guiding post, and the reciprocating squeezing unit has a horizontal guiding groove which the eccentric guiding post is disposed in.

5. The cleaning agent supply device of claim 1, wherein the radian-adjustable fan-shaped light-blocking unit has a plurality of ridge-and-furrow reflecting units.

6. The cleaning agent supply device of claim 1, wherein the photosensitive counting unit is U-shaped to sense the radian-adjustable fan-shaped light-blocking unit, and the reciprocating squeezing unit is U-shaped.

7. The cleaning agent supply device of claim 1, wherein the count control unit has a power switch, a power indicating unit, a time number setting unit, a squeezing count indicating unit, a hand sensing unit and a power supply unit.

8. The cleaning agent supply device of claim 1, wherein a first blocking frame is disposed between the rotary driving unit and the holder.

9. The cleaning agent supply device of claim 1, wherein the holder has a battery receiving chamber, a battery lid, and a second blocking frame disposed between the battery lid and the battery receiving chamber.

10. The cleaning agent supply device of claim 1, further comprising a rear plate and a third blocking frame disposed between the rear plate and the holder.

* * * * *